United States Patent [19]

Regge

[11] Patent Number: 4,499,826

[45] Date of Patent: Feb. 19, 1985

[54] CENTRAL GEAR DRIVEN FLEXOGRAPHIC PRINTING PRESS ACCOMMODATING DIFFERENT DIAMETER PLATE CYLINDERS

[75] Inventor: Dieter Regge, Lengerich, Fed. Rep. of Germany

[73] Assignee: Windmoller & Holscher, Lengerich, Fed. Rep. of Germany

[21] Appl. No.: 451,346

[22] Filed: Dec. 20, 1982

[30] Foreign Application Priority Data

Dec. 22, 1981 [DE] Fed. Rep. of Germany ..... 3150833

[51] Int. Cl.[3] ..... B41F 5/16

[52] U.S. Cl. ..... 101/181

[58] Field of Search ..... 101/181, 180, 183, 184, 101/182, 219, 221, 138, 139

[56] References Cited

U.S. PATENT DOCUMENTS

| | | | |
|---|---|---|---|
| 293,313 | 2/1884 | Cottrell | 101/184 |
| 558,592 | 4/1896 | Meisel | 101/180 |
| 1,095,527 | 5/1914 | Seymour | 101/183 |
| 1,399,360 | 4/1921 | Meisel | 101/184 |
| 1,401,422 | 12/1921 | Meisel | 101/184 |
| 1,440,787 | 1/1923 | Meisel | 101/184 |
| 1,911,325 | 5/1933 | Sanderson | 101/181 |
| 2,084,281 | 6/1937 | Meisel | 101/181 |
| 2,151,961 | 3/1939 | Erickson | 101/182 |
| 3,179,045 | 4/1965 | Evers | 101/181 |
| 3,190,218 | 6/1965 | Willard | 101/184 |

*Primary Examiner*—Edgar S. Burr
*Assistant Examiner*—M. J. Hirabayashi
*Attorney, Agent, or Firm*—Fleit, Jacobson, Cohn & Price

[57] ABSTRACT

In a flexographic printing press comprising a plurality of plate cylinders and backing cylinders driven by a central gear, the pitch circles of the backing cylinder gears are so covered by the central gear that, if they are projected laterally, they make contact with the pitch circle of the central gear. In the region of contact, the plate cylinder gears engage the central gear as well as the backing cylinder gears. The axes of the backing cylinders are pivotable relative to the axis of the central gear to accommodate plate cylinders of different diameters and maintain the axes of the cooperating plate and backing cylinders on a single diametrial line through the axis of the central gear.

7 Claims, 6 Drawing Figures

FIG. 4
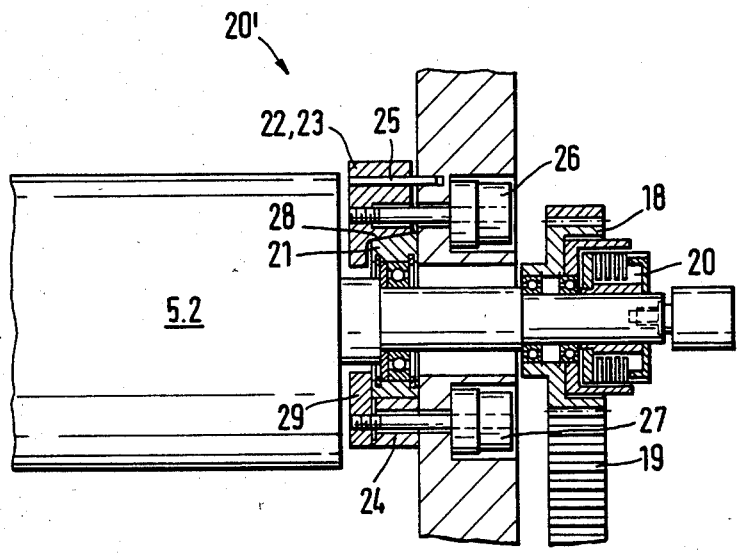
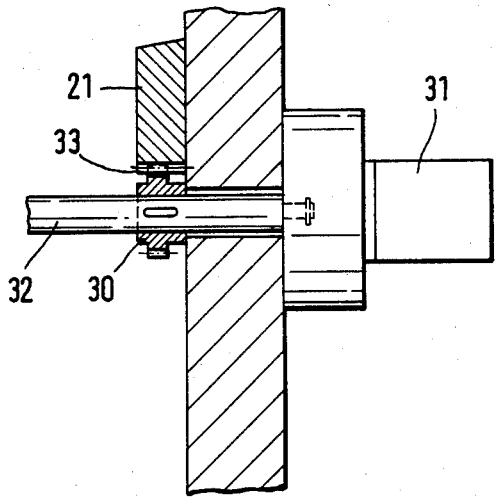
FIG. 5

CENTRAL GEAR DRIVEN FLEXOGRAPHIC PRINTING PRESS ACCOMMODATING DIFFERENT DIAMETER PLATE CYLINDERS

The invention relates to a flexographic printing press comprising a plurality of inking units and a plurality of plate cylinders and backing cylinders driven by a central gear, wherein the plate cylinders and inking unit cylinders are mounted on carriages and can be applied to and removed from the associated backing cylinders, which are carried on guides arranged to permit pivoting of the axes of the backing cylinders radially of the central gear.

In a flexographic printing press of this kind known from DE-PS No. 742 317, the backing cylinder gear engages the central gear and the shaft of the backing cylinder has a second gear keyed to it which engages the plate cylinder gear. Thus, since the plate cylinder is operatively connected to the central gear by way of two intermediate gears, two sets of gear play occur and these have a detrimental effect on the accuracy of registration in the case of multi-color printing. If, therefore, a more accurate degree of registration is required, such as in the case of screen printing, it is necessary to use an expensive flexographic printing press having only a single central backing cylinder.

Apart from the requirement for a high degree of accuracy in registration, high-grade flexographic printing presses should be simply and rapidly convertible to different printing sizes. A change in the size requires replacement of the plate cylinders. Because of the different shaft spacings, the flexographic printing press known from DE-PS No. 742 317 makes the replacement of the plate cylinders relatively cumbersome.

It is therefore an object of the present invention to provide a flexographic printing press having a plurality of inking units, that can be simply and rapidly converted to different plate cylinders sizes and gives a good accuracy of registration.

According to the invention, this problem is solved in a flexographic printing press of the aforementioned kind in that the pitch circles of the backing cylinder gears are so positioned relative to the central gear that, in their axially parallel projection, they substantially make contact with the inside of the pitch circle of the central gear, and that in the regions of contact the plate cylinder gears engage the central gear as well as the backing cylinder gears.

In the flexographic printing press according to the invention, the plate cylinder gears are in direct engagement with the central gear to result in a high degree of accurate registration in the case of multi-color printing. This is because play occurs only once between the plate cylinder and the central gear and such play cannot have a detrimental effect because all the plate cylinder gears have tooth flanks which lie against the respective flanks of the teeth of the central gear.

Despite direct driving of the plate cylinder gears by the central gear, different diameter plate cylinders can be readily brought into contact with the backing cylinders because, basically, no correction of the radial distances of the axes of the shafts of the backing cylinders is required relative to the axis of the central gear because the backing cylinder gears are driven by the central gear through the plate cylinder gears.

However, since not all the plate cylinders can be moved on diametral lines of the central gear for the purpose of applying them to and removing them from the backing cylinders, one aspect of the invention provides that the axes or shafts of the backing cylinders can be pivoted relative to and fixed on an enveloping cylinder concentric with the axis of the central gear, thereby ensuring that, in the printing position, the axes of the plate cylinder and backing cylinder pair lie on a diametral line of the central gear. The displacement of the shafts or axes of the backing cylinders on the surface of the ideal enveloping cylinder is particularly desirable if there are large differences between the diameters of the original and substituted plate cylinders because in that cast only very loose engagement of the teeth of the gears of the backing cylinders and plate cylinders could occur without any correction of the position of the axis of the backing cylinders. Basically, even a large amount of play between the backing cylinder gears and plate cylinder gears will not be disadvantageous for the printing operation because the phase position of the individual backing cylinders within the gear play is stabilised by the web to be printed.

The variability of the size in flexographic printing presses also requires that individual printing mechanisms can be switched off, i.e. so that, say, only four out of six available printing mechanisms can be employed. To avoid the condition where the backing cylinders associated with the individual inoperative printing mechanisms have to be rotated by the web to be printed, a further aspect of the invention provides that on the shafts of the backing cylinders and in a plane parallel to the central gear there are freely rotatable gears over which a toothed belt runs, and that the gears can be connected to the shafts by a clutch so that they rotate therewith. This construction ensures that the backing cylinders of inoperative printing mechanisms will be independently driven at web speed.

One example of the invention will now be described in more detail with reference to the drawing, wherein:

FIG. 4 is a section through the bearing on line IV—IV in FIG. 3;

FIG. 5 is a section through the bearing on the line V—V in FIG. 3, and

Figure 1:
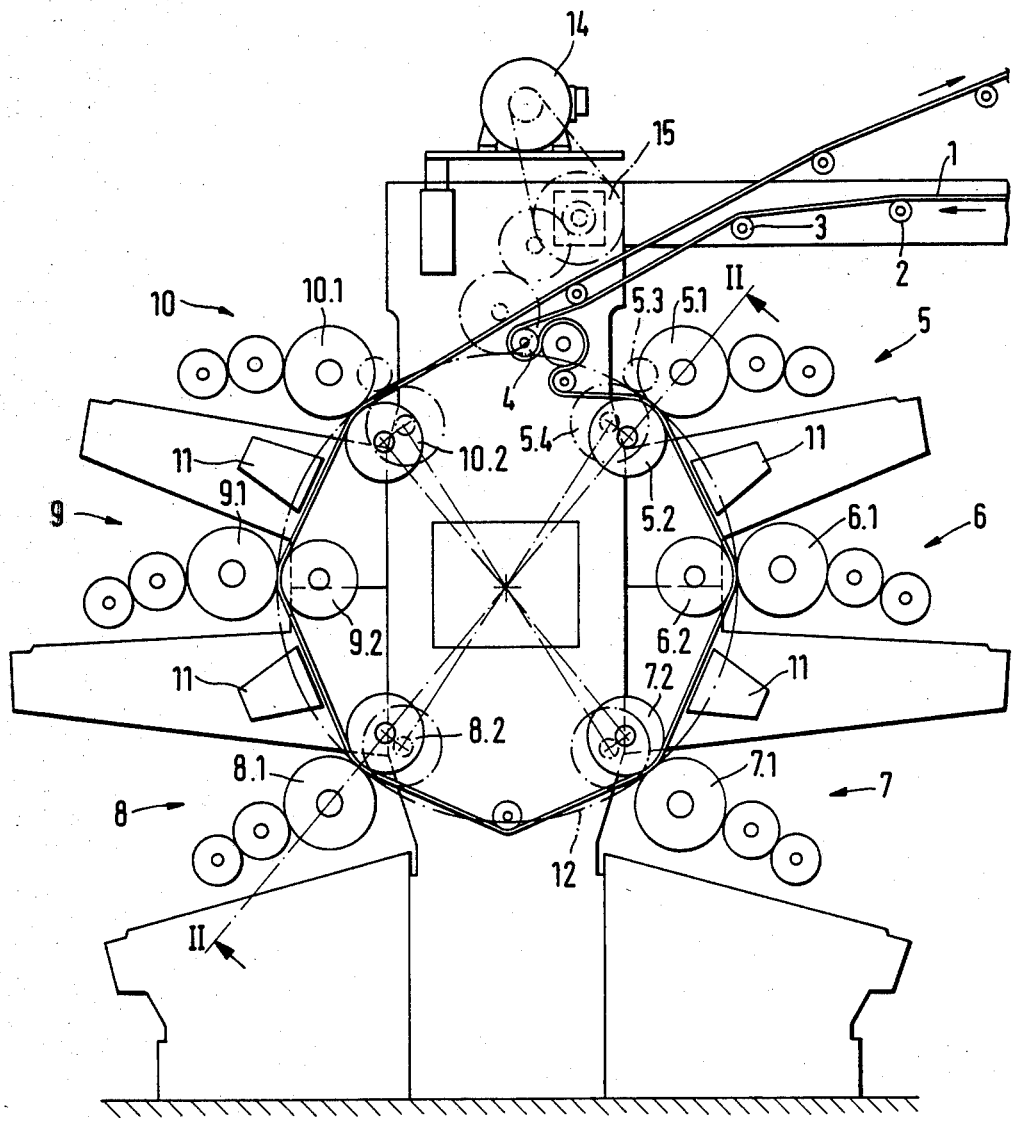
FIG. 1 is a diagrammatic section through a flexographic printing press having six plate and backing cylinders and six inking units.

A web 1 to be printed is fed to and from the FIG. 1 flexographic printing press by conventional guide rollers 2, 3, 4 and additional guide rollers which are not shown or referenced. The illustrated flexographic printing press comprises six printing mechanisms 5 to 10 of which the inking units are disposed at different angles to the horizontal. The plate cylinders 5.1 to 10.1 are associated with individual backing cylinders 5.2 to 10.2. Web dryers 11 are provided between the individual printing mechanisms.

Figure 2:
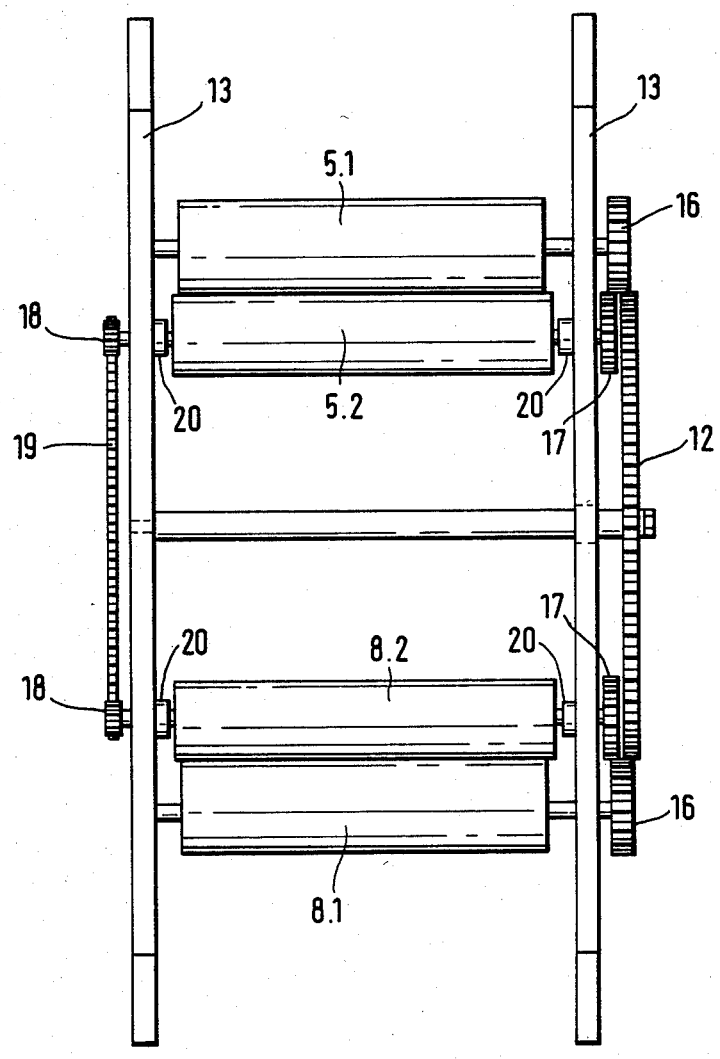
FIG. 2 is a section on the line II—II of the FIG. 1 printing press.

The drive of the plate and backing cylinders is evident from FIG. 2. A gear 12 is mounted in the frame 13 and is driven by a motor 14 (see FIG. 1) acting through a gear train 15. Gears 16 fixed to the plate cylinders engage the gear 12 and gears 17 secured to the shafts of the backing cylinders. This ensures that each plate cylinder gear engages with the associated backing cylinder without the need for any intermediate gears, whereby the cylinders of the printing mechanism run absolutely in unison.

If a fewer number of colors is to be printed than there are printing mechanisms, those backing cylinders which do not participate in the printing would have to be driven by the web to be printed. To avoid this, the free ends of the shafts of backing cylinders 5.2 to 10.2 carry toothed belt gears 18 to which a toothed belt 19 is applied. Pneumatic clutches 20 are provided between the toothed belt gears 18 and the respective shaft of the backing cylinders so that each backing cylinder that would otherwise be driven by the web can be driven by the toothed belt. It will be evident that in this case the clutch of a backing cylinder participating in the printing will also be switched on so that the toothed belt will itself be driven. To compensate for length differences in the toothed belt 19, there is a tensioning device (not shown). If the plate cylinders 5.1 to 10.1 have to be replaced with, for example, smaller cylinders referenced 5.3 (see FIG. 1), it is necessary to pivot about the axis of gear 12 the axes of the backing cylinders of those printing mechanisms in which the smaller plate cylinders are not displaced inwardly towards the axis of the central gear 12. In the illustrated example of FIG. 1, this applies to the printing mechanisms 5, 7, 8 and 10. The position of the backing cylinder 5.2 after pivoting is designated 5.4. To carry out the pivoting motion, pivoting means 20' (see FIG. 4) are provided for the backing cylinders 5.2, 7.2, 8.2 and 10.2. These pivoting means consist of an annular segment 21 rotatably supporting the shaft of the backing cylinder 5.2 which is in contact with either of the plate cylinders 5.1 or 5.3. The annular segment 21 is guided between outer annular segment members 22, 23, and an inner annular segment member 24 secured to the frame 13. The annular segment members 22, 23 are axially movable supported by pins 25 secured in the frame 13 and are pulled towards the frame 13 lengthwise of the pins 25 by pneumatic cylinders 26. This movement serves to fix the annular segment 21.

Facing the annular segment 21, the annular segments 22, 23 have an inclined, inwardly directed face 28 corresponding to an inclined, outwardly directed face provided on the annular segment 21. During locking, the pneumatic cylinders 26 are first actuated so that the annular segment 21 is pressed against the annular segment 24 by the inclined face 28. Thereafter, the pneumatic cylinders 27, actuated of which the piston rods are fixed to a cover plate 29, are actuated. The cover plate 29 is likewise axially movable supported in pins 25. In the locked position, the cover plate 29 is supported on the annular segment 21 and pulls it towards the frame 13 by the actuation of pneumatic cylinders 27. By means of this motion executed by the pneumatic cylinders 26, 27, the annular segment 21 is fixed in a defined position relative to frame 13.

Figure 3:
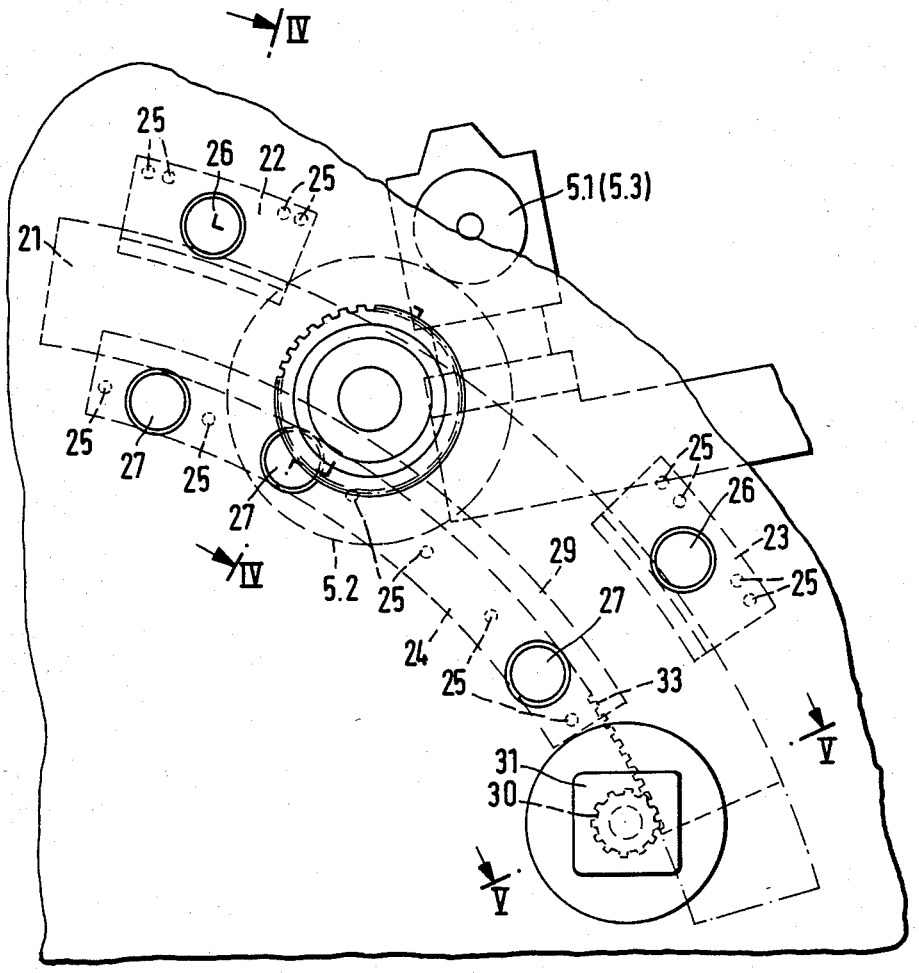
FIG. 3 is an enlarged side elevation of the bearing of one backing cylinder.
Figure 6:
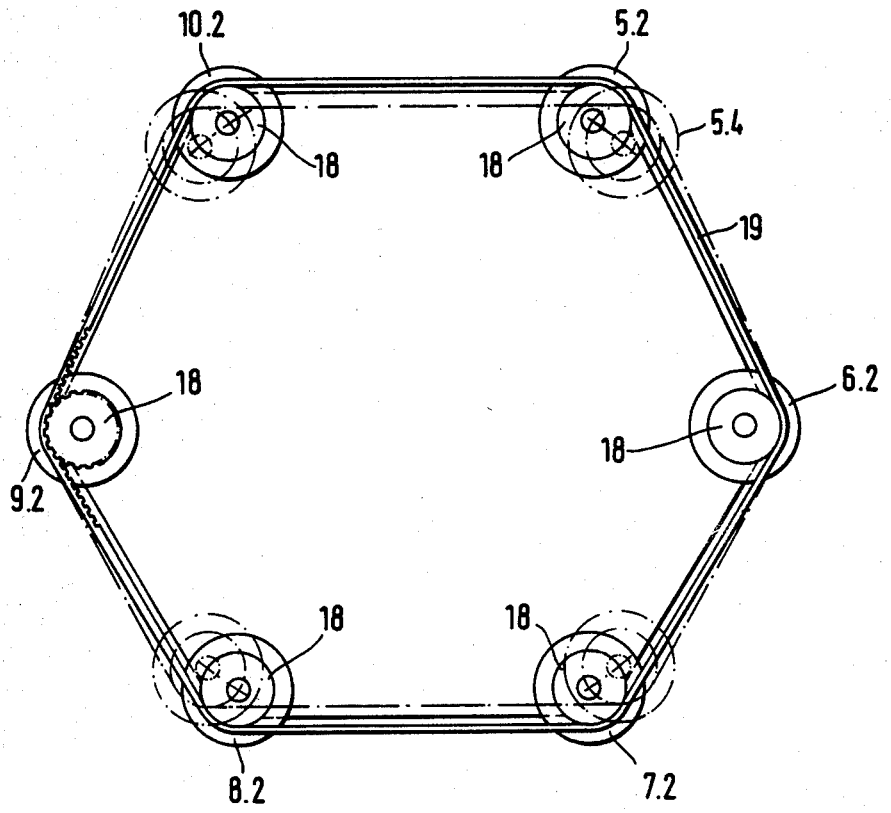
FIG. 6 is a diagrammatic side elevation of the drive for further running of the backing cylinder.

To pivot the axes of the backing cylinders relative to the plate cylinders, part of the annular segment 21 is provided with teeth 33 (see FIGS. 3 and 5) engaging a pinion 30 driven by a servo-motor 31 with the aid of a shaft 32.

The pivoting angle of the axes of the backing cylinders may be preprogrammed in relation to the diameter of the plate cylinders in an electric circuit (not shown) which feeds pulses to the servo-motor 31.

I claim:

1. A flexographic printing press comprising: a plurality of plate cylinders and backing cylinders each having gears driven by a central gear, the backing cylinders including drive gears having pitch circles that when projected axially fall within and contact the inside of the pitch circle of the central gear, the plate cylinder gears engaging the central gear as well as the backing cylinder gears; the backing cylinders each including additional freely rotatable gears; a toothed belt passing around each of the additional gears; and clutch means for drivingly connecting said additional gears with their associated backing cylinders.

2. A flexographic printing press comprising:

a frame;

a plurality of plate cylinders each having a cooperating backing cylinder, each of the plate and backing cylinders mounted on rotatable shafts having gears and rotatably supported on said frame;

a central gear; the shafts of the backing cylinders are rotatably carried in annular segment supporting members, means mounting said supporting members for circumferential displacement along a circular path concentric with the central gear; and clamping means to clamp said supporting members against said frame.

3. A flexographic printing press according to claim 2, wherein said clamping means includes jaws axially displaceable on guide pins secured to said frame.

4. A flexographic printing press according to claim 3, wherein said supporting members and said jaws each have contacting surfaces inclined relative to the axis of the associated backing cylinder, said contacting surfaces being of complementary shape.

5. A flexographic printing press according to claim 3, wherein the clamping jaws are connected to piston rods of piston-cylinder means which when actuated produce the clamping forces.

6. A flexographic printing press according to claim 2 wherein said supporting members have teeth that engage with pinions, said pinions driven by servo-motors to move said supporting members along said circular path.

7. A flexographic printing press according to claim 1, wherein said clutch means includes a pressure-actuated plate clutch.

* * * * *